United States Patent [19]

Kinnunen

[11] Patent Number: 4,756,790

[45] Date of Patent: Jul. 12, 1988

[54] APPARATUS FOR CONNECTING A WEB TO A WINDING ROLL IN CONTINUOUS REELING APPARATUS

[75] Inventor: Jorma Kinnunen, Järvenpää, Finland

[73] Assignee: Oy Wartsila AB, Finland

[21] Appl. No.: 905,181

[22] Filed: Sep. 9, 1986

[30] Foreign Application Priority Data

Sep. 19, 1985 [FI] Finland ..... 853608

[51] Int. Cl.[4] ..... B31F 5/06; B65H 19/18

[52] U.S. Cl. ..... 156/504; 29/125; 29/130; 156/505; 242/58.3; 242/58.5

[58] Field of Search ..... 156/157, 502, 504, 505, 156/DIG. 42, 273.1, 583.1; 242/58.1, 58.3, 58.5; 361/214, 221; 29/125, 130

[56] References Cited

U.S. PATENT DOCUMENTS

| | | | |
|---|---|---|---|
| 1,962,928 | 6/1934 | Durham | 242/58.3 |
| 3,233,526 | 2/1966 | Sherman | 156/504 |
| 3,558,406 | 1/1971 | Kugler | 156/515 |
| 3,940,305 | 2/1976 | Stenberg | 156/515 |
| 4,155,516 | 5/1979 | Hughes et al. | 242/58.1 |
| 4,238,261 | 12/1980 | Tetro | 156/505 |
| 4,277,996 | 7/1981 | Spengler | 83/170 |
| 4,494,166 | 1/1985 | Billings et al. | 361/214 |
| 4,655,865 | 4/1987 | Nozaka | 156/157 |

*Primary Examiner*—Michael Wityshyn

*Attorney, Agent, or Firm*—Steinberg & Raskin

[57] ABSTRACT

Apparatus for use in continuous web reeling apparatus for connecting a web to a winding roll as the web is being unwound from an unwinding roll by deflecting a run of the web and pressing the deflected web against joining tape provided on the surface of the winding roll. The apparatus includes a plurality of axially aligned pressing members, a fluid-actuated expandable actuating device for exerting pressure on the pressing members to cause the pressing members to move against the web to exert a joining force on the web to press the web against the joining tape provided on the surface of the winding roll, and a spring device for returning the pressing members to their original position after the web has been connected to the winding roll.

18 Claims, 2 Drawing Sheets

APPARATUS FOR CONNECTING A WEB TO A WINDING ROLL IN CONTINUOUS REELING APPARATUS

BACKGROUND OF THE INVENTION

The present invention relates generally to apparatus for use in continuous web reeling apparatus for connecting a web to a winding roll as the web is being unwound from an unwinding roll, and more particularly to such connecting apparatus which operates by pressing the web against joining tape, preferably double-sided joining tape, provided on the surface of the winding roll.

It is presently conventional to utilize a unitary or continuous roll for connecting a web to a winding roll by pressing the web against joining tape provided on the surface of the winding roll as the web is being unwound from an unwinding roll.

However, the use of such continuous rolls has certain drawbacks. In particular, since the widths of webs currently being manufactured are quite large, continuous or unitary connecting rolls have become quite large and heavy. The great weight of the connecting rolls make their use unreliable and do not function satisfactorily, especially in applications where the web must be joined to the winding roll in very short times.

SUMMARY OF THE INVENTION

It is an object of the invention to provide new and improved apparatus for connecting a web to a winding roll in continuous web reeling apparatus.

Another object of the present invention is to provide new and improved web connecting apparatus which operate in a reliable manner at high running speeds.

Still another object of the present invention is to provide new and improved apparatus for connecting a web to a winding roll at very high running speeds.

A further object of the present invention is to provide new and improved apparatus for use in continuous web reeling apparatus for connecting a web to a winding roll and which is applicable in the processing of various types of webs.

Briefly, in accordance with the present invention, these and other objects are obtained by providing apparatus comprising means for deflecting a run of the web and depressing the deflected web against joining tape provided on the surface of the winding roll, wherein the deflecting and depressing means include a plurality of substantially axially aligned, elongated pressing members, and fluid-actuated expandable actuating means for exerting pressure on the pressing members under which the pressing members move from a first position to a second position against the web to exert a joining force on the web to press the web against the joining tape provided on the surface of the winding roll to connect the web thereto. The apparatus also comprises spring means for returning the pressing members to the first position after the web has been connected to the winding roll.

Other detailed features of the invention will become apparent from the following description of a preferred embodiment.

DESCRIPTION OF THE FIGURES

A more complete appreciation of the present invention and many of the attendant advantages thereof will be readily understood by references to the following description when considered in connection with the accompanying drawings in which.

DETAILED DESCRIPTION OF THE PREFERRED EMBODIMENTS

Figure 1:
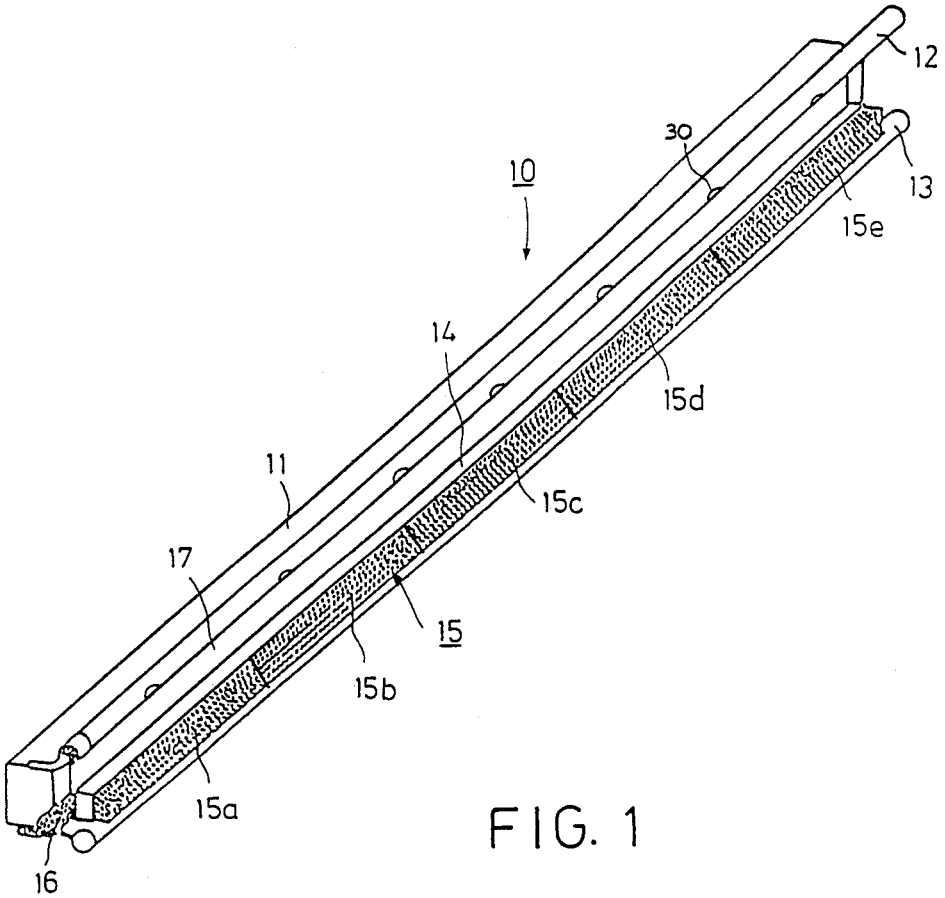
FIG. 1 is a perspective view of one embodiment of web connecting means for use in continuous web reeling apparatus in accordance with the invention.
Figure 2:
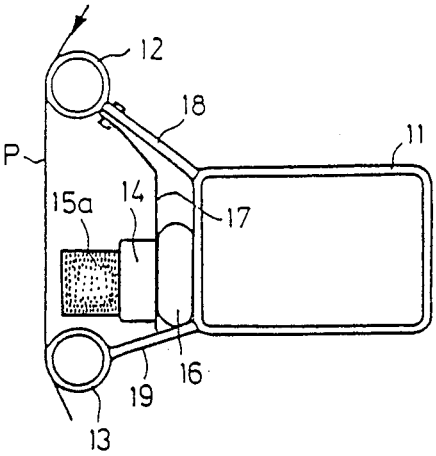
FIG. 2 is a transverse section view of the web connecting apparatus illustrated in FIG. 1.

Referring to the drawings wherein like reference characters designate identical or corresponding parts throughout the several views, and more particularly to FIGS. 1 and 2, a first embodiment of web connecting apparatus, generally designated 10, in accordance with the invention, for use in continuous web reeling apparatus is illustrated. The web connecting apparatus 10 comprises a frame in the form of a beam 11, web guides 12 and 13 connected to the frame beam 11 by brackets 18 and 19 for defining a run of the web P, means, generally designated 15, for deflecting a run of the web P and depressing the deflected web against joining tape provided on the surface of a winding roll, fluid-actuated expandable actuating means 16, and spring means affixed to one of the brackets 18 and to which the web deflecting and depressing means are attached.

According to the basic principle of the invention, the deflecting and depressing means 15 comprise a plurality of substantially axially aligned, elongated pressing members positioned transversely with respect to the run of the web P, the plurality of pressing members adapted to be moved by fluid-operated actuating means 16 in order to deflect the web P and press the deflected web against joining tape provided of the surface of a winding roll to connect the web thereto.

In the embodiment of FIGS. 1 and 2, the web deflecting and depressing means comprise a plurality of brush sections or members **15*a*, 15*b*, 15*c*, 15*d* and 15*e* of suitable length mounted on supporting structure 14. The stiffness and quality of the bristles of each of the brush members are selected in accordance with the characteristics of the web P being connected to the winding roll. Carbon fibers are preferably blended with the bristles of the brush members 15*a* . . . 15*e*** which contact the web P to electrically ground the web and to prevent the web from becoming charged with static electricity.

The plurality of brush members are mounted through the supporting structure 14 to free end of a spring 17 which has been arranged to return the brush assembly comprising the brush members and supporting structure to its original position as described in greater detail below. The spring 17 preferably comprises a one-piece return spring formed of a strip of hardened spring steel having a relatively great width. The other end of the spring 17 is connected to the upper bracket 18 which supports the upper web guide 12.

The fluid-actuated expandable actuating means 16 is positioned in the space between the frame beam 11 and the rear surface of spring 17. Actuating means 16 comprises a flexible pressure tube, preferably in the form of a fabric-reinforced hose. One end of the pressure tube 16 is adapted to be connected to a source of pressurized fluid in order to effect expansion of the tube 16. Upon such expansion a run of the web P is deflected from its normal run between guides 12 and 13 and depressed against joining tape provided on the surface of the winding roll. Thus, a fluid, preferably compressed air, is conducted into the flexible pressure tube which then expands to exert a pressure on the brush members 15*a* . . . 15*e* under which the brush members move from a first position to a second position against the web to in turn exert a joining force on the web to press the web against the joining tape provided on the surface of the winding roll. The tape preferably comprises a double-sided joining tape of the type disclosed, for example, in Finnish application No. 84 2802.

As noted above, after the web has been connected to the joining tape on the winding roll, the spring 17 returns the brush members 15*a* . . . 15*e* to its original position. As mentioned above, the web guides 12 and 13 are connected by brackets 18 and 19 to the frame beam 11. The web guides 12 and 13 preferably comprise tubular members, each extending substantially parallel to the pressing members 15*a* . . . 15*e*. It will be understood that the outer web-engaging surface of the web guides 12 and 13 should be ground to a smooth condition.. Further, at least one of the web guides 12 comprise a fluid conduit in which fluid apertures are formed. The end of web guide 12 is adapted to be connected to a source of pressurized fluid, such as compressed air, so that during operation, fluid is discharged from the apertures for blowing away any scraps of the web which may have been produced during the web cutoff operation.

In operation, a fluid under pressure, preferably compressed air, is directed into the expandable actuating means 16 which thereby expands to move the brush members from a first position to a second position against the web P to exert a joining force thereon and to thereby press the web against the joining tape provided on the surface of the winding roll to connect the web thereto. The joining tape is preferably a double-sided joining tape which is in itself known. For example, reference is made to Finnish application No. 84 2802 which discloses such joining tape.

After the connection of the web P to the winding roll has been completed, the spring 17 returns the brush assembly 14, 15 to its original position. As noted above, the web guides 12 and 13 are connected by brackets 18 and 19 to the frame beam 11 with the web guides having smooth surfaces which engage the web P. The frame beam 11 of the web connecting apparatus 10 preferably comprises a square tube and the spring 17 is preferably attached to the upper bracket 18. The end of the spring 17 is attached, such as by bolts, to the upper bracket 18 whereby the end of the spring 17 so fixed to bracket 18 functions as a hinge.

Figure 4:
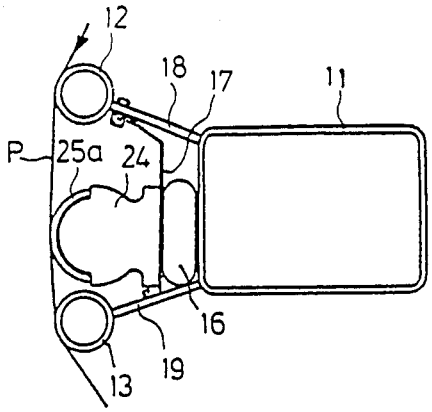
FIG. 4 is a transverse section view of the web connecting apparatus illustrated in FIG. 3.
Figure 3:
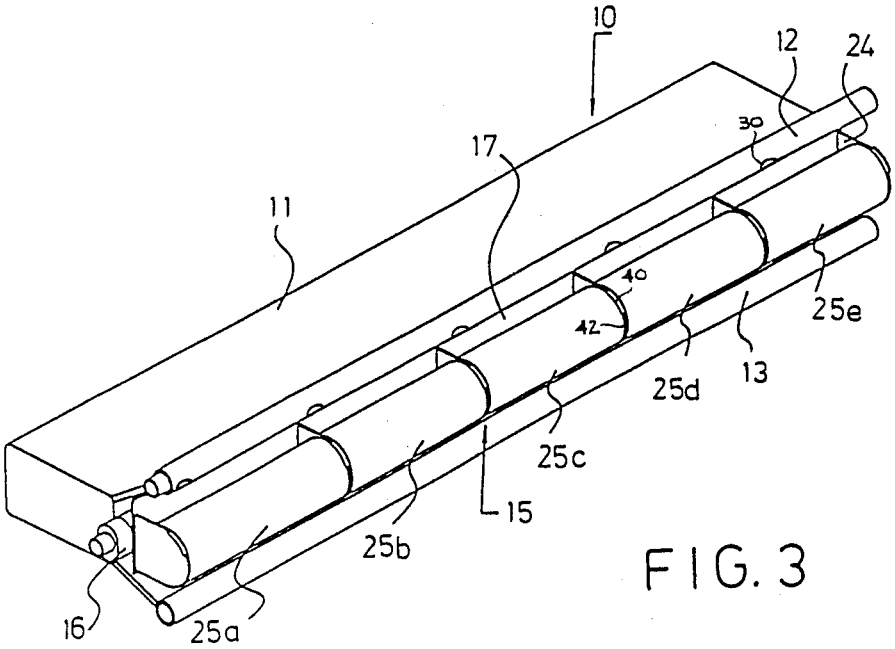
FIG. 3 is a perspective view of another embodiment of web connecting apparatus for use in continuous web reeling apparatus in accordance with the invention.

Referring to the embodiment of the invention illustrated in FIGS. 3 and 4, the apparatus 10 is essentially similar to the embodiment illustrated in FIGS. 1 and 2, except that in the embodiment of FIGS. 3 and 4, the pressing members comprise rotatable roll members 25*a*, 25*b*, 25*c*, 25*d* and 25*e*. The connecting rolls 25*a* . . . 25*e* are preferably quite light and may comprise tubular members formed of cylindrical shells 24 made of aluminum or other light material coated with rubber.

The rolls 25*a* . . . 25*e* are rotatably mounted in bearings (not shown) and each pair of adjacent roll members, e.g., 25*c* and 25*d*, form a gap 40 between them. In order that the roll members 25*a* . . . 25*e* exert a continuous joining force on the web, means 42 are provided for filling the gaps 40. For example, the means 42 may comprise small brushes or flexible strips that bridge the gaps between the rolls 25 at the bearings.

The embodiment of FIGS. 3 and 4 is advantageous in those cases in which the pressure exerted by the brush members 15*a* . . . 15*e* of the embodiment of FIGS. 1 and 2 might not be sufficient. The connecting rolls 25*a* . . . 25*e* rotate through frictional engagement with the web and therefore no separate drive is required for the rolls. The small inertia of the rolls 25 also provides an advantage in that a change in the radius resulting from compression of the rolls 25 will cause a rapid change in the roll. By providing the rolls 25*a*–25*e* of light weight material and in a tubular construction, any rebounding of the rolls upon contact with the web P is essentially eliminated.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. Apparatus for use in continuous web reeling apparatus for connecting a web to a winding roll as the web is being unwound from an unwinding roll by pressing the web against joining tape provided on the surface of the winding roll, comprising:

means for deflecting a run of the web and depressing the deflected web against joining tape provided on the surface of the winding roll, said deflecting and depressing means including a plurality of substantially axially aligned, elongated pressing members positioned transversely with respect to the web run, and fluid-actuated expandable actuating means for exerting pressure on said pressing members under which said pressing members move from a first position to a second position against the web to exert a joining force on the web to press the web against the joining tape provided on the surface of the winding roll to connect the web thereto; and spring means for returning said pressing members to said first position after the web has been connected to the winding roll;

wherein said pressing members comprise rotatable roll members; and wherein each of said roll members are rotatably mounted in bearings, each pair of adjacent roll members forming a gap between them, and wherein means are provided for filling said gaps to ensure that said roll members exert a continuous joining force on the web.

2. The combination of claim 1 wherein said roll members are provided with a rubber coating.

3. The combination of claim 1 wherein said roll members comprise tubular members formed of cylindrical shells.

4. The combination of claim 3 wherein said cylindrical shells of said roll members are formed of aluminum.

5. The combination of claim 1 wherein said gap filling means comprise brushes situated at said gaps.

6. The combination of claim 1 wherein said gap filling means comprise flexible strips situated at said gaps.

7. The combination of claim 1 wherein said spring means comprise a return spring including a wide strip of spring steel.

8. The combination of claim 1 wherein said actuating means comprise a flexible pressure tube.

9. The combination of claim 8 wherein said pressure tube comprises a fabric-reinforced hose.

10. The combination of claim 1 further including means for engaging and guiding said web run including a pair of elongated web guide members extending substantially parallel to said pressing members, each web guide member being situated on a respective side of said pressing members.

11. The combination of claim 10 wherein at least one of said web guide members comprises a fluid conduit in which fluid apertures are formed and adapted to be connected to a source of pressurized fluid so that during operation, fluid is discharged from said apertures for blowing away scraps of the web produced during a web cut-off operation.

12. The combination of claim 10 wherein each of said web guide members comprises a tubular member.

13. The combination of claim 12 wherein each of said tubular web guide members has a outer surface engaging the web and wherein said outer surface comprises a smooth surface.

14. The combination of claim 1 wherein said apparatus further includes a frame beam to which said depressing and deflecting means are coupled.

15. The combination of claim 14 wherein said deflecting and depressing means are coupled to said frame beam by said spring means.

16. The combination of claim 15 further including means coupled to said frame beam for engaging and guiding said web run including a pair of elongated web guide members extending substantially parallel to said pressing members, each web guide member being situated on a respective side of said pressing members.

17. The combination of claim 16 wherein each of said elongated web guide members are coupled to said frame beam by a respective bracket plate.

18. The combination of claim 17 wherein said spring means are connected to one of said bracket plates and said pressing members are coupled to said spring means.

* * * * *